US006048003A

United States Patent [19]

Shimura

[11] Patent Number: 6,048,003

[45] Date of Patent: Apr. 11, 2000

[54] DOOR LOCK DEVICE WITH HALF-LATCH DETECTOR

[75] Inventor: Ryoji Shimura, Yokohama, Japan

[73] Assignee: Ohi Seisakusho Col., Ltd., Yokohama, Japan

[21] Appl. No.: 09/049,472

[22] Filed: Mar. 27, 1998

[30] Foreign Application Priority Data

Mar. 28, 1997 [JP] Japan ..... 9-078089

[51] Int. Cl.[7] ..... E05C 3/06

[52] U.S. Cl. ..... 292/216; 292/201; 292/DIG. 23

[58] Field of Search ..... 292/216, 201, 292/DIG. 23, DIG. 46, DIG. 43, 341.16, 341.17, 336.3

[56] References Cited

U.S. PATENT DOCUMENTS

| | | | |
|---|---|---|---|
| 4,968,074 | 11/1990 | Yamagishi et al. | 292/216 |
| 5,137,311 | 8/1992 | Brackmann | 292/DIG. 43 |
| 5,156,359 | 10/1992 | Noble et al. | 70/208 |
| 5,429,400 | 7/1995 | Kawaguchi et al. | 292/341.16 |
| 5,516,164 | 5/1996 | Kobayashi | 292/DIG. 23 |
| 5,577,782 | 11/1996 | Johnson et al. | 292/216 |
| 5,618,068 | 4/1997 | Mitsui et al. | 292/216 |
| 5,785,364 | 7/1998 | Kleefeldt et al. | 202/201 |
| 5,832,669 | 11/1998 | Mizuki et al. | 49/360 |

*Primary Examiner*—Teri Pham
*Attorney, Agent, or Firm*—Foley & Lardner

[57] ABSTRACT

A door lock device comprises a latch plate pivotally connected to the body and a pawl member pivotally connected through a pivot shaft to the body and engageable with the latch plate to retain the same in given positions. The pawl member is secured to the pivot shaft to move therewith. An open lever is secured to the pivot shaft so that the open lever and the pawl member pivot like a single unit. A detecting lever is pivotally connected to the pivot shaft. A first structure is provided for pivoting the detecting lever in a first direction to a given position only when the open lever is pivoted in the first direction. A second structure is provided for retaining the detecting lever in the given position even when the open lever is pivoted back in a second direction opposite to the first direction. A detecting switch is actuated by the detecting lever when the latter comes to the given position.

9 Claims, 6 Drawing Sheets

DOOR LOCK DEVICE WITH HALF-LATCH DETECTOR

BACKGROUND OF THE INVENTION

1. Field of the Invention

The present invention relates in general to an automotive door lock device, and more particularly, to an automotive door lock device incorporated with an electric door closure, through which the automotive door can be shifted from a half-latch position to a full-latch position by electric power. More specifically, the present invention is concerned with the automotive door locks of a type which is equipped with a half-latch position detector.

2. Description of the Prior Art

As is known, an electric door closure is a device which, with an aid of a door lock device, shifts an automotive slide door from a half-latch position to a full-latch position by electric power. In practical use, upon sensing the half-latch condition of the slide door wherein a latch plate of the door lock device is incompletely engaged with a striker, the electric door closure is energized. With this, the door closure forces the latch plate to pivot to its full-latch position causing the slide door to take a fully closed latched position relative to a door opening of the vehicle body. For detecting the half-latch condition of the slide door, a half-latch detector is commonly used.

FIG. 11 shows a conventional half-latch detector incorporated with a door lock device. The half-latch detector comprises a detecting switch "B" which senses a movement of an open lever "A" of the door lock device. The open lever "A" is integrally connected with a pivotal pawl member which is engageable with a pivotal latch plate of the lock device. That is, when the pawl member is engaged with the latch plate to retain the same in a half-latch or full-latch position, the open lever "A" assumes an engaging position as shown by a phantom line "A1", while, when the pawl member is disengaged from the latch plate to leave the same at an open position, the open lever "A" assumes a release position as shown by a solid line "A2". By sensing the movement of the open lever "A" to the engaging position "A1" from the release position "A2", the detecting switch "B" detects the half-latch condition of the slide door. More specifically, when, due to the closing movement of the slide door, the latch plate is brought into engagement with the striker and thus pivoted by the same to the half-latch position causing the open lever "A" to take the engaging position "A1", a detector pin of the detecting switch "B" is pushed by the open lever "A" to turn the switch "B" ON. With this ON operation, the half-latch condition of the slide door is detected.

However, the conventional half-latch detector has the following drawback.

That is, due to the inherent construction of the door lock device, the open lever "A" is forced to assume the engaging position "A1" also when the pawl member is engaged with the latch plate in the full-latch position. In other words, the engaging position "A1" of the open lever "A" is established in both a case wherein the latch plate assumes the half-latch position and the other case wherein the latch plate assumes the full-latch position. Thus, if, due to application of a stronger force, the slide door is rushingly moved in a closing direction causing the latch plate to instantly take the full-latch position passing through the half-latch position, the detecting switch "B" fails to detect the half-latch condition of the door.

SUMMARY OF THE INVENTION

It is therefore an object of the present invention to provide an automotive door lock device with a half-latch detector, which is free of the above-mentioned drawback.

According to the present invention, there is provided an automotive door lock device having a half-latch detector which can assuredly detect the half-latch condition of the door lock.

According to a first aspect of the present invention, there is provided a door lock device which comprises a body; a latch plate pivotally connected to the body; a pawl member pivotally connected through a pivot shaft to the body and engageable with the latch plate to retain the same in given positions, the pawl member being secured to the pivot shaft to move therewith; an open lever secured to the pivot shaft so that the open lever and the pawl member pivot like a single unit; a detecting lever pivotally connected to the pivot shaft; first means for pivoting the detecting lever in a first direction to a given position only when the open lever is pivoted in the first direction; second means for retaining the detecting lever in the given position even when the open lever is pivoted back in a second direction opposite to the first direction; and a detecting switch which is actuated by the detecting lever assuming the given position.

According to a second aspect of the present invention, there is provided a door lock device which comprises a striker; a body; a latch plate pivotally connected to the body, the latch plate being capable of assuming an open position wherein the latch plate releases the striker, a half-latch position wherein the latch plate incompletely engages with the striker and a full-latch position wherein the latch plate completely engages with the striker; a pawl member pivotally connected through a pivot shaft to the body and engageable with the latch plate to retain the same in the open, half-latch and full-latch positions, the pawl member being secured to the pivot shaft to move therewith; an open lever secured to the pivot shaft so that the open lever and the pawl member pivot like a single unit; a detecting lever pivotally connected to the pivot shaft; first means for pivoting the detecting lever in a first direction to a given position only when the open lever is pivoted in the first direction; second means for retaining the detecting lever in the given position even when the open lever is pivoted back in a second direction opposite to the first direction; and a detecting switch fixed to the body, the detecting switch being actuated by the detecting lever when the detecting lever comes to the given position.

According to a third aspect of the present invention, there is provided a control system for controlling an automotive slide door. The control system comprises an electric door closure device mounted to the door; a door lock device mounted to the door and comprising a body; a latch plate pivotally connected to the body; a pawl member pivotally connected through a pivot shaft to the body and engageable with the latch plate to retain the same in given positions, the pawl member being secured to the pivot shaft to move therewith; an open lever secured to the pivot shaft so that the open lever and the pawl member pivot like a single unit; a detecting lever pivotally connected to the pivot shaft; first means for pivoting the detecting lever in a first direction to a given position only when the open lever is pivoted in the first direction; second means for retaining the detecting lever in the given position even when the open lever is pivoted back in a second direction opposite to the first direction; and a detecting switch which is actuated by the detecting lever assuming the given position, and a movement transmitting device arranged between the electric door closure device and the door lock device to force the latch plate to pivot to a given position when the electric door closure device is energized.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Referring to FIGS. 1 to 9 of the drawings, there is shown a first embodiment of the present invention.

Figure 1:
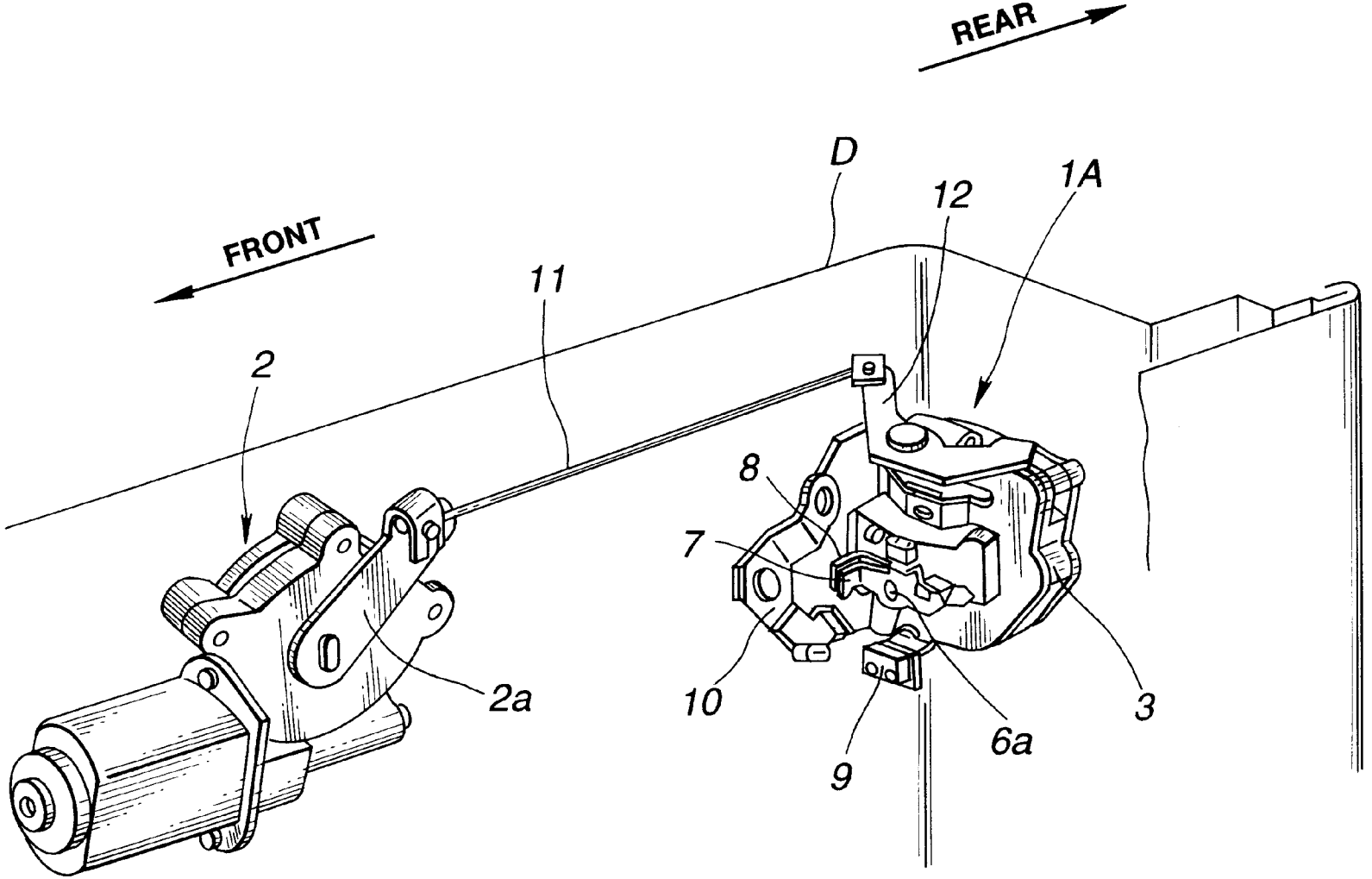
FIG. 1 is a drawing showing a door control unit including a door lock device and an electric door closure, the door lock device being a first embodiment of the present invention.

In FIG. 1, an automotive slide door "D" is shown as having a door control unit mounted thereto. The door control unit comprises a door lock device 1A (more specifically, door lock proper) and an electric door closure 2. Although not shown in the drawing, a striker is secured to a vehicle body, to which the door lock proper 1A becomes incompletely or completely engaged when the slide door "D" comes near or to a fully closed position in a door opening formed in the vehicle body.

As will be clarified hereinafter, when the slide door "D" comes to a half-latch position (or a position just before a full-latch position), the electric door closure 2 becomes energized to shift the slide door "D" to the full-latch position by electric power with an aid of the door lock device.

Figure 7:
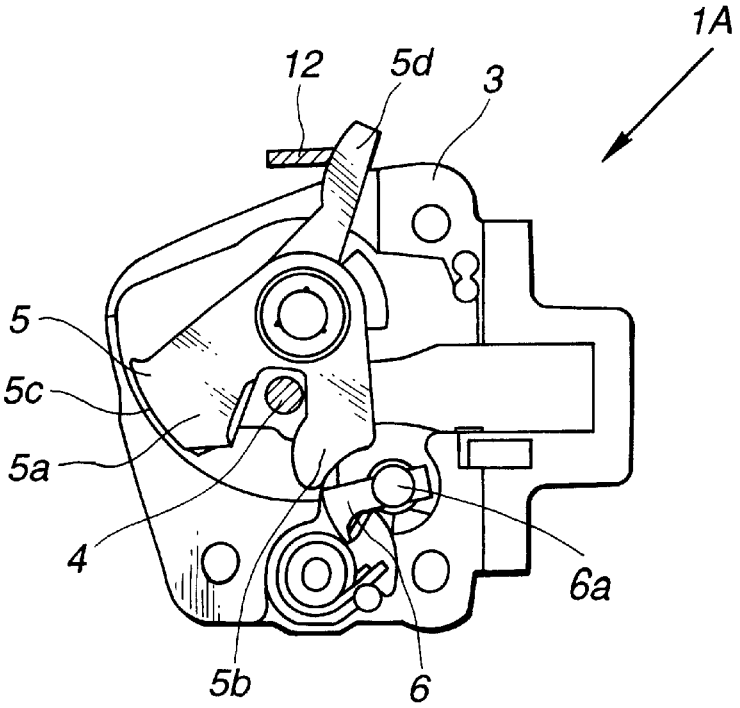
Figure 8:
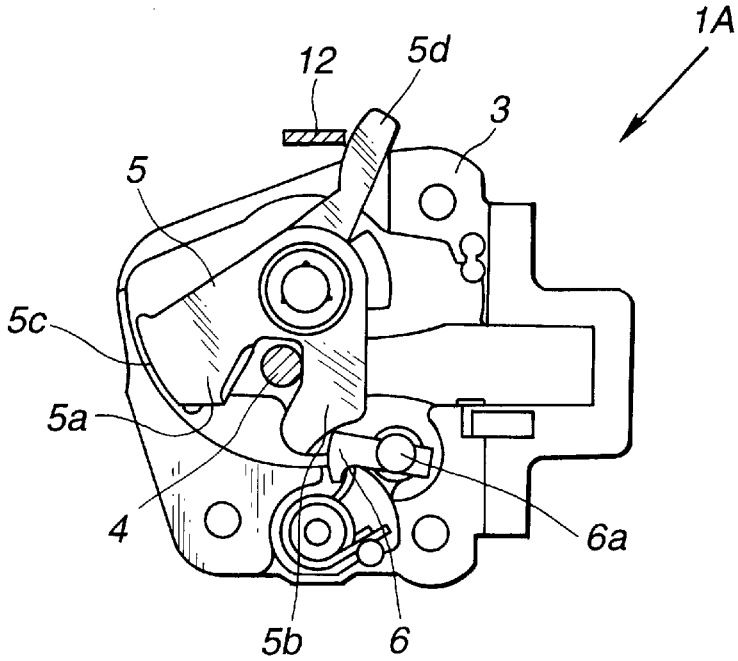
Figure 9:
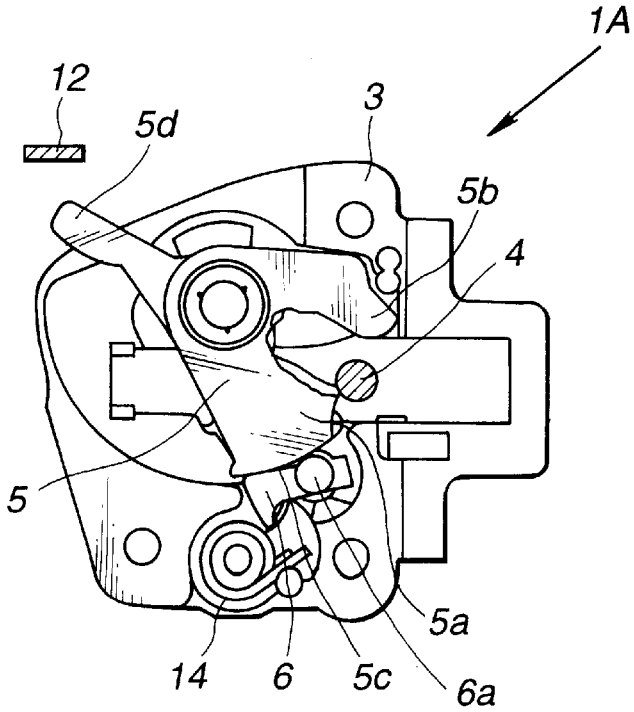

As is seen from FIGS. 6 to 9, particularly FIG. 9, the door lock proper 1A comprises a body 3. Within the body 3, there are pivotally installed a latch plate 5 and a pawl member 6. The pawl member 6 has a pivot shaft 6*a* secured thereto, so that the pawl member 6 and the pivot shaft 6*a* pivot like a single unit. A biasing spring (not shown) is applied to the latch plate 5 to pivot in a counterclockwise direction in FIG. 9, and another biasing spring 14 is applied to the pawl member 6 to pivot in a clockwise direction in FIG. 9. The pawl member 6 is engageable with the latch plate 5 to retain the same in a half-latch position or a full-latch position. As is understood from the drawing, when the slide door "D" comes near the fully closed position, the latch plate 5 becomes ready for engaging with a striker 4 which is secured to the vehicle body.

Figure 6:
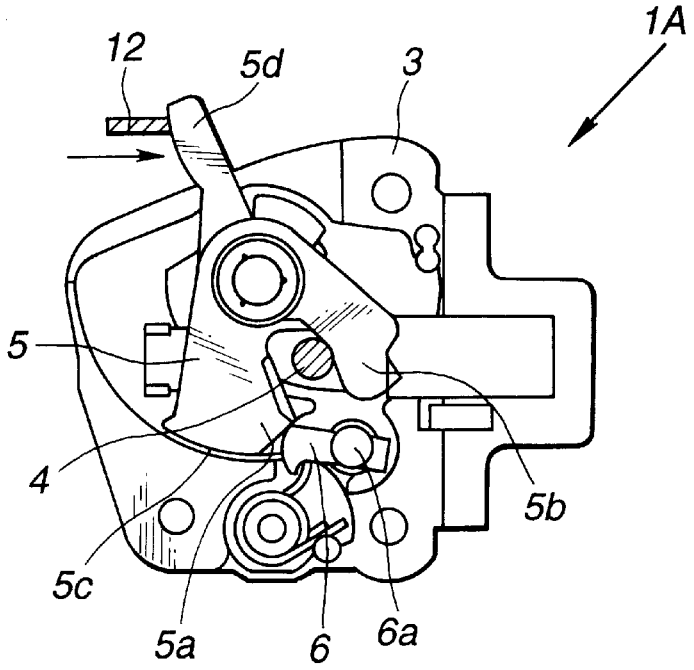
FIGS. 6 to 9 are interior views of the door lock device of the first embodiment in various conditions, the views being taken from the other side of the door lock device.

The latch plate 5 has three typical positions, which are an open position wherein as is shown in FIG. 9 the latch plate 5 is released from the striker 4, a half-latch position wherein as is shown in FIG. 6 the latch plate 5 is incompletely engaged with the striker 4 and a full-latch position wherein as is shown in FIG. 8 the latch plate 5 is completely engaged with the striker 4.

The latch plate 5 is formed with half-latch and full-latch engaging arms 5*a* and 5*b* between which a striker receiving recess (no numeral) is defined. The latch plate 5 has further a lever portion 5*d* to which an after-mentioned closing lever 12 is operatively engageable.

As is seen from FIG. 6, the half-latch position of the latch plate 5 is obtained when the half-latch engaging arm 5*a* thereof is engaged with the pawl member 6, and as is seen from FIG. 8, the full-latch position of the latch plate 5 is obtained when the full-latch engaging arm 5*b* is engaged with the pawl member 6.

Figure 11:
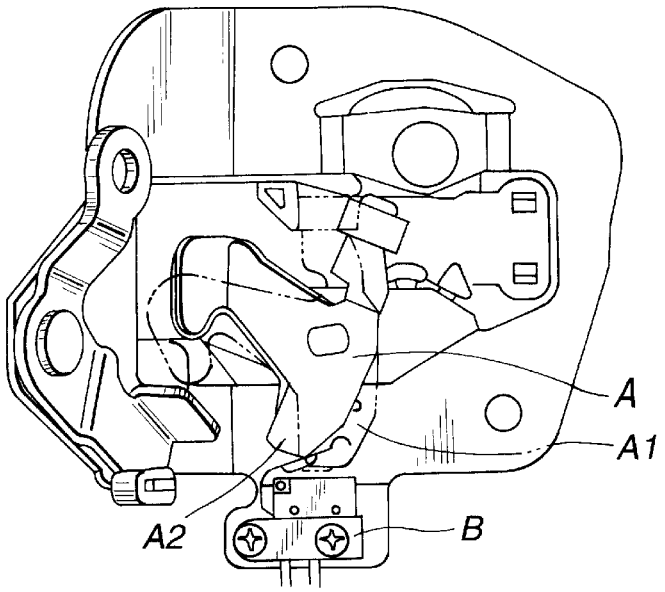
FIG.11 (PRIOR ART)
FIG. 11 is a front view of a conventional door lock device equipped with a half-latch detector.

It is to be noted that like in the case of the above-mentioned conventional door lock device of FIG. 11, to retain the latch plate 5 in the half-latch and full-latch positions, the pawl member 6 assumes the same engaging position.

As will be understood from FIG. 9, when the latch plate 5 assumes the open position, the pawl member 6 releases the latch plate 5. That is, in this case, the pawl member 6 is in abutment with a periphery 5*c* of the half-latch engaging arm 5*a*, assuming a disengaging position as shown in FIG. 9.

When applied with a certain force, the pawl member 6 can be pivoted counterclockwise in FIG. 9 but slightly from the disengaging position to assume a releasing position. Thus, when the pawl member 6 assumes this releasing position, the pawl member 6 is completely disengaged from the latch plate 5.

Figure 2:
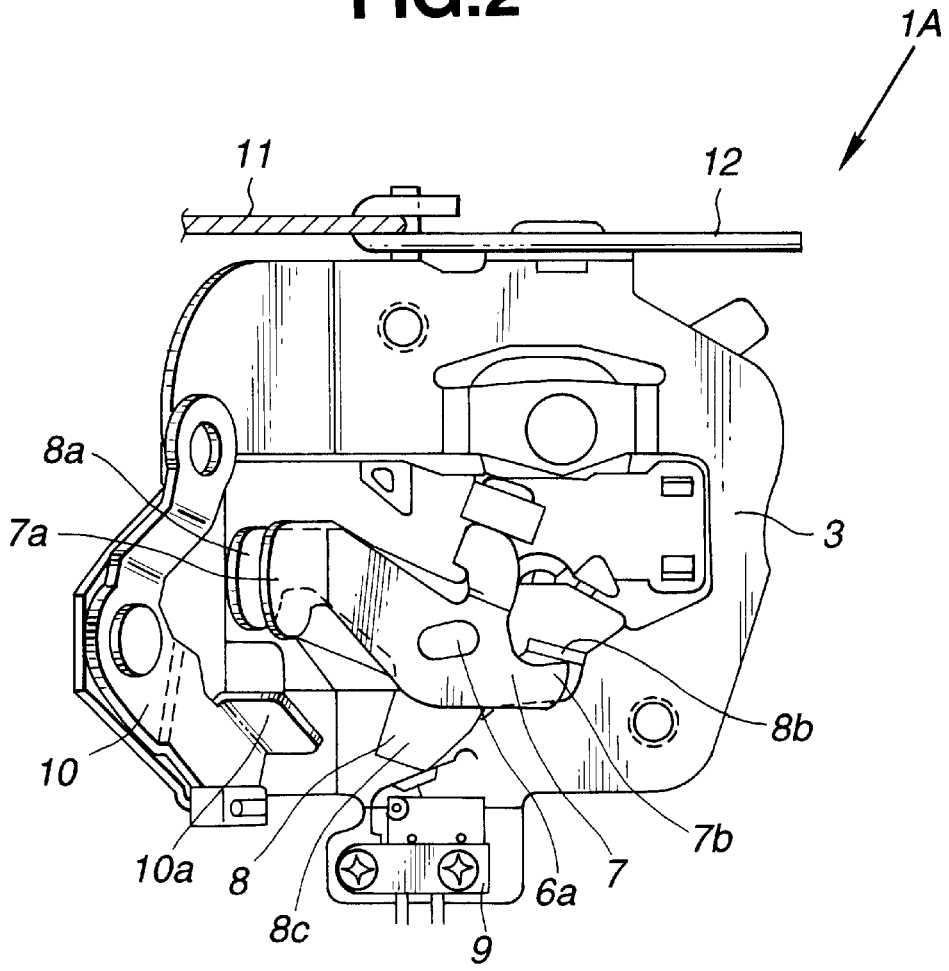
FIG. 2 is a front view of the door lock device of the first embodiment of the present invention.

As is seen from FIG. 2, on one side of the body 3, there are arranged an open lever 7, a detecting lever 8, a detecting switch 9, a canceling lever 10 and a closing lever 12.

The open lever 7 is secured to the pivot shaft 6*a* of the pawl member 6 to pivot together with the pawl member 6. The detecting lever 8 is pivotally connected to the pivot shaft 6*a* of the pawl member 6. A suitable friction material is applied between the detecting lever 8 and the pivot shaft 6*a* to provide a non-smoothed or frictional pivoting movement of the detecting lever 8 relative to the pivot shaft 6*a*. The detecting switch 9 is secured to the body 3 and detects the position change of the detecting lever 8 to issue a so-called "half-latch signal". The canceling lever 10 is pivotally connected to the body 3. Although not shown in the drawing, one end of the canceling lever 10 is linked to outside and inside door handles operatively mounted to the slide door 2. The closing lever 12 is pivotally connected to the body 3. As shown in FIG. 2, from one end of the closing lever 12, there extends a cable 11 to a driving lever 2*a* (see FIG. 1) of the electric door closure 2. As has been described hereinabove, the closing lever 12 has one end operatively engageable with the lever portion 5*d* (see FIGS. 6 and 9) of the latch plate 5.

As is seen from FIG. 2, the open lever 7 has both a canceling end portion 7*a* which is engageable with an actuating end portion 10*a* of the canceling lever 10, and a driving end portion 7*b* which is engageable with the detecting lever 8.

Figure 3:
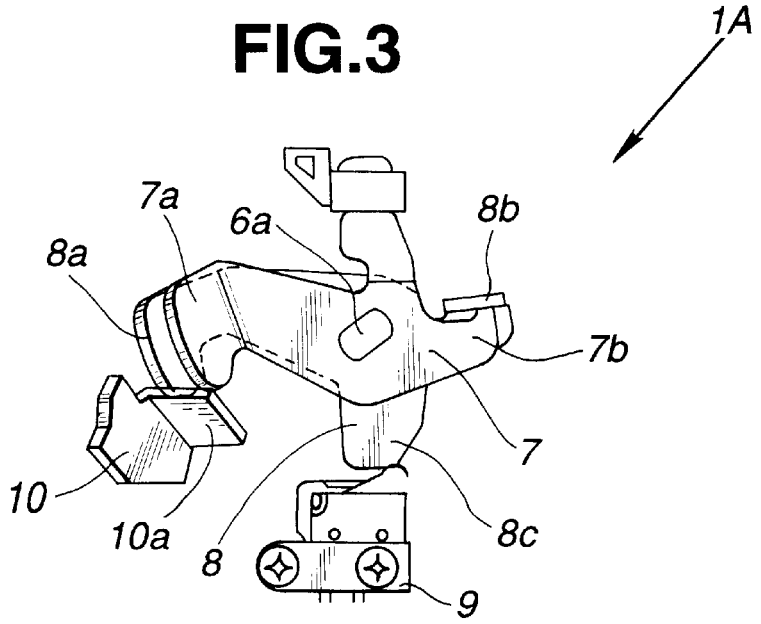
FIGS. 3 to 5 are illustrations of essential parts of the door lock device of the first embodiment in various conditions, the illustrations being taken from one side of the door lock device.
Figure 4:
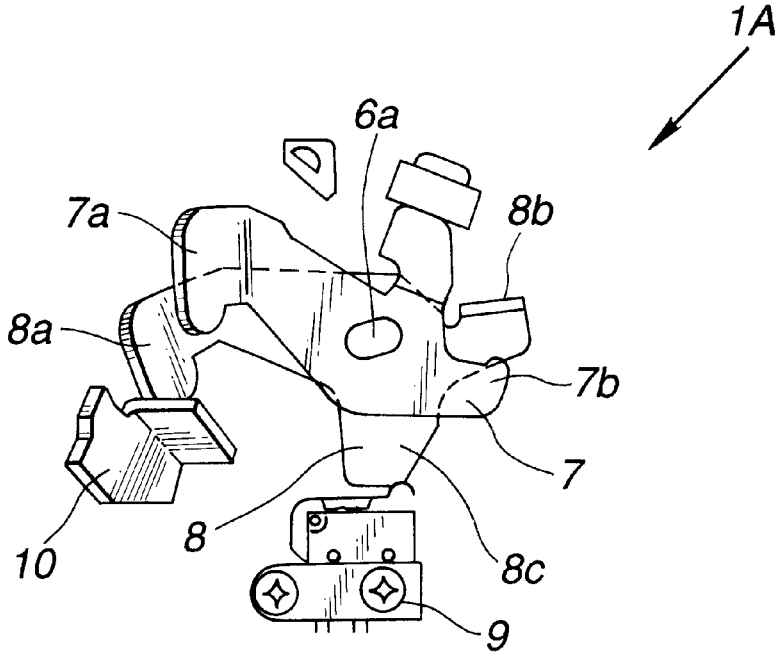
Figure 5:
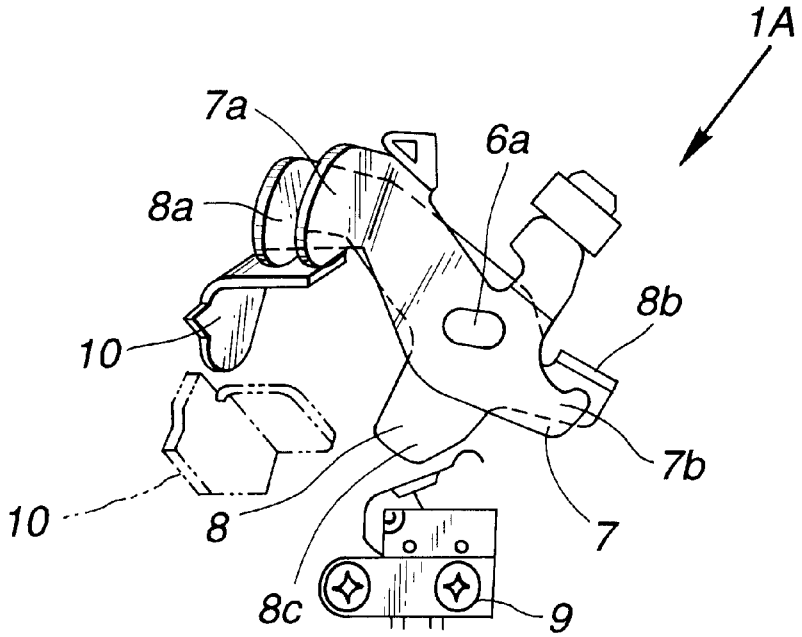

When the pawl member 6 assumes the above-mentioned engaging position (viz., the position to permit the latch plate 5 to take the half-latch or full-latch position), the open lever 7 assumes its engaging position as shown in FIG. 3, and when the pawl member 6 assumes the above-mentioned releasing position (viz., the position to permit the latch plate 5 to take the open position), the open lever 7 assumes its releasing position as shown in FIG. 5, and when the pawl member 6 assumes the above-mentioned disengaging position (viz., the position to permit the latch plate 5 to take the open position), the open lever 7 assumes its disengaging position as shown in FIG. 4 and FIG. 2.

As is understood from FIG. 2, the detecting lever 8 comprises a releasing end portion 8*a* which is engageable with the actuating end portion 10*a* of the canceling lever 10, a driven end portion 8*b* which is engageable with the driving end portion 7*b* of the open lever 7 and a detecting end portion 8*c* which is engageable with the detecting switch 9. The driven end portion 8*b* is formed by bending a portion of the detecting lever 8, as shown. Abutment of the driving end portion 7*b* of the open lever 7 against the driven end portion 8*b* of the detecting lever 8 is established only when the open lever 7 is pivoted counterclockwise in FIG. 2 toward the engaging position of FIG. 3. As is seen from FIG. 3, when the open lever 7 is in the engaging position, the detecting end portion 8*c* of the detecting lever 8 pushes a detector pin of the detecting switch 9 to turn the same ON.

The detecting lever 8 has three typical positions, which are a releasing position wherein as shown in FIG. 5 the detecting lever 8 has been pivoted up by the canceling lever 10, a disengaging position wherein as shown in FIG. 3 the latch plate 5 assumes the open position, and an engaging position wherein as shown in FIGS. 3 and 4 the detecting end portion 8*c* of the of the lever 8 pushes the detector pin of the detecting switch 9.

It is to be noted that due to provision of the friction material applied between the detecting lever 8 and the pivot shaft 6*a*, the detecting lever 8 is prevented from play when assuming the disengaging and engaging positions.

As is mentioned hereinabove, when the detecting lever 8 is moved to the engaging position, the detecting end portion 8*c* of the same pushes the detector pin of the detecting switch 9. With this, the detecting switch 9 issues a half-latch signal.

When, due to the closing movement of the slide door "D", the latch plate 5 is brought into engagement with the striker and thus pivoted by the same to the half-latch position (the position as shown in FIG. 6), the detecting switch 9 is turned ON and thus issues the half-latch signal. Upon this, the electric door closure 2 (see FIG. 1) is energized to pull the closing lever 12 through the cable 11, so that the latch plate 5 of the door lock proper 1A is pivoted clockwise in FIG. 6 to the full-latch position as shown in FIG. 8. With this, the slide door "D" assumes the fully closed latched position in the door opening.

When, for opening the slide door "D", one of the outside and inside door handles is manipulated, the canceling lever 10 (see FIG. 5) is pivoted from a position shown by a phantom line to a position shown by a solid line. With this pivoting, both the open lever 7 and the detecting lever 8 are pivoted to their releasing positions and the pawl member 6 is disengaged from the latch plate 5 to release the same. Thus, when, with the door handle kept manipulated, a certain force is applied to the slide door D in a direction to open the same, the slide door "D" can be opened.

In the following, operation of the above-mentioned door lock device 1A of the first embodiment will be described with reference to the drawings.

For ease of understanding, the description will be commenced with respect to an open condition of the door lock proper 1A as shown in FIG. 2. That is, the slide door "D" is kept opened. In the open condition of the door lock proper 1A, the latch plate 5 assumes the open position (see FIG. 9) and the open lever 7 and the detecting lever 8 assume their disengaging positions. That is, the detecting lever 8 assumes the disengaging position as shown in FIG. 2. That is, in the open condition of the door lock proper 1A, the detecting end portion 8*c* of the detecting lever 8 fails to push the detector pin of the detecting switch 9, thereby causing the switch 9 to assume OFF condition.

When now the slide door "D" is moved near the fully closed position in the door opening, the striker 4 secured to the vehicle body is led into the striker 4 receiving recess of the latch plate 5 of the door lock proper 1A. Further movement of the slide door "D" toward the fully closed position causes the striker 4 to pivot the latch plate 5 to the half-latch position of FIG. 6. That is, during this period, the latch plate 5 is pivoted from the open position of FIG. 9 to the half-latch position of FIG. 6.

Upon arrival of the latch plate 5 at the half-latch position, the pawl member 6 is brought into engagement with the half-latch engaging arm 5*a* of the latch plate 5 as shown in FIG. 6. That is, upon the arrival of the latch plate 5, the pawl member 6 is pivoted to the engaging position and thus the open lever 7 is pivoted counterclockwise in FIG. 2 to the engaging position as shown in FIG. 3. (It is to be noted that the open lever 7 and the pawl member 6 constitute a signal unit). Due to abutment of the driving end portion 7*b* against the driven end portion 8*b*, the counterclockwise pivoting of the open lever 7 induces a simultaneous pivoting of the detecting lever 8 to its engaging position of FIG. 3. In this engaging position, the detecting end portion 8*c* of the detecting lever 8 pushes the detector pin of the detecting switch 9 to turn the switch 9 ON. Upon this, the switch 9 issues the half-latch signal.

As is understood from the above, when the latch plate 5 is pivoted to the half-latch position by the striker 4, the detecting switch 9 is turned ON and thus issues the half-latch signal. Upon this, the electric door closure 2 (see FIG. 1) is energized to pull the closing lever 12 through the driving lever 2*a* and the cable 11, with the result that the latch plate 5 of the door lock proper 1A is pivoted clockwise in FIG. 6 to the full-latch position of FIG. 8 through an intermediate position of FIG. 7. With this, the slide door "D" assumes the fully closed latched position in the door opening.

When the slide door "D" finally comes to the fully closed latched position, another switch (not shown) issues a closing completion signal to energize the electric door closure 2 to pivot the driving lever 2*a* in a reversed direction. With this, the closing lever 12 is returned to its original rest position as shown in FIG. 1.

When the opened slide door "D" is rushingly moved in a closing direction, it tends to occur that the slide door "D" stops at an unstable position just before the fully closed latch position in the door opening. That is, as is seen from FIG. 7, in such an unstable condition of the door "D", the latch plate 5 assumes the intermediate position between the half-latch position of FIG. 6 and the full-latch position of FIG. 8. More specifically, due to the rushing movement of the slide door "D" toward the fully closed position, the latch plate 5 is pivoted to the intermediate position passing through the half-latch position. During this pivoting of the latch plate 5, the pawl member 6 has a moment to engage with the half-latch engaging arm 5*a* of the latch plate 5 and thus the open lever 7 and the detecting lever 8 have a moment to assume their engaging positions. In other words, during the above-mentioned pivoting of the latch plate 5, the door lock proper 1A has a moment as depicted by FIG. 3. Thus, in this moment, the detecting switch 9 assumes ON condition.

As is understood from FIGS. 6 and 7, once the latch plate 5 passes through the half-latch position, the pawl member 6 runs on the periphery 5*c* of the full-latch engaging arm 5*b*, so that the open lever 7 (and the pawl member 6) is returned back to the disengaging position (see FIG. 4) from the engaging position (see FIG. 3). This means that the open lever 7 assuming the engaging position of FIG. 3 is pivoted back to the disengaging position of FIG. 4. However, as is easily understood from FIG. 4, the back pivoting of the open lever 7 has no effect on the detecting lever 8, and thus detecting lever 8 is left at the engaging position with an aid of the friction material applied between the detecting lever 8 and the pivot shaft 6*a* about which the detecting lever 8 pivots. Thus, the ON condition of the detecting switch 9 is kept even when the open lever 7 is pivoted back to the disengaging position. Upon receiving the half-latch signal (or ON signal) from the detecting switch 9, the electric door closure 2 (see FIG. 1) is energized to pivot the latch plate 5 of FIG. 7 to the full-latch position of FIG. 8.

In the above-mentioned conventional half-latch detector of FIG. 11, there is no means corresponding to the detecting lever 8 employed in the invention. That is, in the prior art, the open lever (7) serves as the detecting lever (8). As is described hereinabove, when the pawl member (6) runs on the periphery (5*c*) of the latch plate (5), the open lever (7) is inevitably returned back to the disengaging position. In this position, the open lever (7) fails to turn the detecting switch (9) ON.

Figure 10:
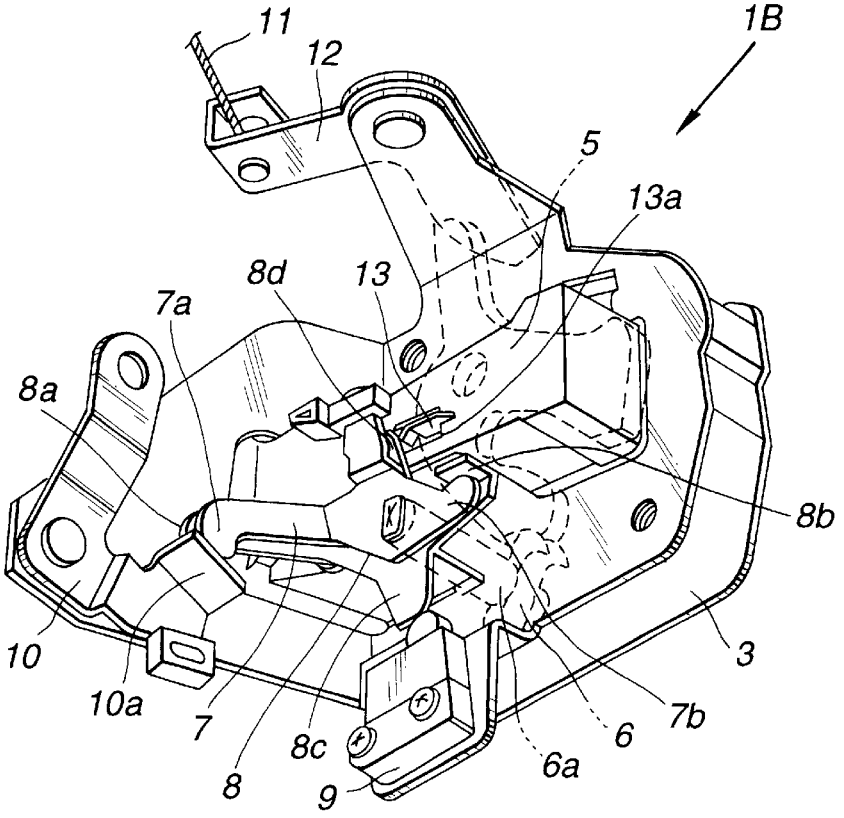
FIG. 10 is a perspective view of a door lock device with a half-latch detector, which is a second embodiment of the present invention.

Referring to FIG. 10, there is shown an automotive door lock device 1B which is a second embodiment of the present invention.

Similar to the first embodiment 1A, the door lock device 1B comprises a body 3, a latch plate 5, a pawl member 6, a pivot shaft 6*a* of the pawl member 6, an open lever 7 having both a canceling end portion 7*a* and a driving end portion 7*b*, a detecting lever 8 which three end portions 8*a*, 8*b* and 8*c*, a detecting switch 9, a canceling lever 10 having an actuating end portion 10*a*, a cable 11 from the door closure unit 2 (see FIG. 1), and a closing lever 12. These parts are arranged in substantially the same manner as those of the above-mentioned first embodiment 10A.

In the second embodiment 1B, the detecting lever 8 is formed with an arm portion 8*d*. A generally W-shaped leaf spring 13 is fixed to the body 3 in such a manner as to resiliently retain the arm portion 8*d* of the detecting lever 8. Thus, the detecting lever 8 is suppressed from play when assuming the disengaging and engaging positions.

It is to be understood that, although the invention has been described with specific reference to particular embodiments thereof, it is not to be so limited since changes and alternations therein may be made within the full intended scope of this invention as defined by the appended claims.

What is claimed is:

1. A door lock device comprising:

a body;

a latch plate pivotally connected to said body;

a pawl member pivotally connected through a pivot shaft to said body and engageable with said latch plate to retain said latch plate in given positions, said pawl member being secured to said pivot shaft to move therewith;

an open lever secured to said pivot shaft so that said open lever and said pawl member pivot as a single unit;

a detecting lever pivotally connected to said pivot shaft;

first means for pivoting said detecting lever in a first direction to a given position only when said open lever is pivoted in said first direction;

second means for retaining said detecting lever in said given position even when said open lever is pivoted back in a second direction opposite to said first direction; and a detecting switch which is actuated by said detecting lever assuming said given position.

2. A door lock device as claimed in claim 1, in which said first means comprises:

a bent portion defined by said detecting lever; and an end portion of said open lever, which pushes said bent portion when said open lever is pivoted in said first direction.

3. A door lock device as claimed in claim 1, in which said second means comprises a friction material applied between said detecting lever and said pivot shaft.

4. A door lock device as claimed in claim 1, in which said second means comprises:

an arm portion defined by said detecting lever; and a resiliently deformable member fixed to said body, which resiliently retains said arm portion when said detecting lever comes to said given position.

5. A door lock device as claimed in claim 1, further comprising:

a canceling lever pivotally connected to said body, said canceling lever pivoting said open lever and said detecting lever in said second direction when pivoted in a third direction; and a closing lever pivotally connected to said body and operatively engageable with said latch plate, said closing lever pivoting said latch plate to a given position when pivoted in a fourth direction.

6. A door lock device comprising:

a striker;

a body;

a latch plate pivotally connected to said body, said latch plate being capable of assuming an open position wherein said latch plate releases said striker, a half-latch position wherein said latch plate incompletely engages with said striker and a full-latch position wherein said latch plate completely engages with said striker;

a pawl member pivotally connected through a pivot shaft to said body and engageable with said latch plate to retain said latch plate in said open, half-latch and full-latch positions, said pawl member being secured to said pivot shaft to move therewith;

an open lever secured to said pivot shaft so that said open lever and said pawl member pivot as a single unit;

a detecting lever pivotally connected to said pivot shaft;

first means for pivoting said detecting lever in a first direction to a given position only when said open lever is pivoted in said first direction;

second means for retaining said detecting lever in said given position even when said open lever is pivoted back in a second direction opposite to said first direction; and a detecting switch fixed to said body, said detecting switch being actuated by said detecting lever when said detecting lever comes to said given position.

7. A door lock device as claimed in claim 6, in which said first means comprises:

a bent portion defined by said detecting lever; and an end portion of said open lever, which pushes said bent portion when said open lever is pivoted in said first direction, and in which said second means comprises a friction material applied between said detecting lever and said pivot shaft.

8. A door lock device as claimed in claim 6, in which said first means comprises:

a bent portion defined by said detecting lever; and an end portion of said open lever, which pushes said bent portion when said open lever is pivoted in said first direction, and in which said second means comprises:

an arm portion defined by said detecting lever; and a resiliently deformable member fixed to said body, which resiliently retains said arm portion when said detecting lever comes to said given position.

9. A control system for controlling an automotive slide door, comprising:

an electric door closure device mounted to said door;

a door lock device mounted to said door and comprising:

a body;

a latch plate pivotally connected to said body;

a pawl member pivotally connected through a pivot shaft to said body and engageable with said latch plate to retain said latch plate in given positions, said pawl member being secured to said pivot shaft to move therewith;

an open lever secured to said pivot shaft so that said open lever and said pawl member pivot as a single unit;

a detecting lever pivotally connected to said pivot shaft;

first means for pivoting said detecting lever in a first direction to a given position only when said open lever is pivoted in said first direction;

second means for retaining said detecting lever in said given position even when said open lever is pivoted back in a second direction opposite to said first direction; and a detecting switch which is actuated by said detecting lever assuming said given position; and a movement transmitting device arranged between said electric door closure device and said door lock device to force said latch plate to pivot to a given position when said electric door closure device is energized.

* * * * *